US008597060B2

(12) United States Patent
Wu

(10) Patent No.: US 8,597,060 B2
(45) Date of Patent: Dec. 3, 2013

(54) CABLE CONNECTOR ASSEMBLY WITH IMPROVED SOLDERING PORTIONS OF CONTACTS

(75) Inventor: Jerry Wu, Irvine, CA (US)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 16 days.

(21) Appl. No.: 13/328,852

(22) Filed: Dec. 16, 2011

(65) Prior Publication Data

US 2012/0156943 A1 Jun. 21, 2012

(51) Int. Cl.
*H01R 13/516* (2006.01)

(52) U.S. Cl.
USPC ..... 439/660

(58) Field of Classification Search
USPC ..... 439/660, 188, 607.54, 67.55, 607.01
See application file for complete search history.

(56) References Cited

U.S. PATENT DOCUMENTS

2012/0156940 A1* 6/2012 Wu ..... 439/660
2012/0295482 A1* 11/2012 Wu ..... 439/607.54
2013/0040491 A1* 2/2013 Wu ..... 439/607.01
2013/0040492 A1* 2/2013 Wu ..... 439/607.55
2013/0040493 A1* 2/2013 Wu ..... 439/607.55

FOREIGN PATENT DOCUMENTS

CN 201323356 10/2009

* cited by examiner

*Primary Examiner* — Chandrika Prasad

(74) *Attorney, Agent, or Firm* — Wei Te Chung; Ming Chieh Chang

(57) ABSTRACT

A cable connector assembly (100) comprises an insulative housing (1), a plurality of contacts (2), a metallic shell (3) enclosing the insulative housing and a spacer (5). The insulative housing includes a first tongue (121) and a second tongue (122). The contacts comprise a plurality of first contacts held in the first tongue and a plurality of second contacts held in the second tongue. At least one of the contacts comprises a main body (2210), a pair of vertical soldering portions (2212) and a pair of connecting portions (2214), the pair of connecting portions are connected with a top edge and a bottom edge of the main body, and the connecting portions are located on different levels, the pair of soldering portions are stagger with each other.

20 Claims, 11 Drawing Sheets

CABLE CONNECTOR ASSEMBLY WITH IMPROVED SOLDERING PORTIONS OF CONTACTS

BACKGROUND OF THE INVENTION

1. Field of the Invention

The present invention generally relates to a cable connector assembly, and more particularly to a cable connector assembly transmitting high speed signal.

2. Description of Related Art

Recently, personal computers (PC) are used of a variety of techniques for providing input and output. Universal Serial Bus (USB) is a serial bus standard to the PC architecture with a focus on computer telephony interface, consumer and productivity applications. The design of USB is standardized by the USB Implementers Forum (USB-IF), an industry standard body incorporating leading companies from the computer and electronic industries. USB can connect peripherals such as mouse devices, keyboards, PDAs, gamepads and joysticks, scanners, digital cameras, printers, external storage, networking components, etc. For many devices such as scanners and digital cameras, USB has become the standard connection method.

As of 2006, the USB specification was at version 2.0 (with revisions). The USB 2.0 specification was released in April 2000 and was standardized by the USB-IF at the end of 2001. Previous notable releases of the specification were 0.9, 1.0, and 1.1. Equipment conforming to any version of the standard will also work with devices designed to any previous specification (known as: backward compatibility).

USB supports three data rates: 1) A Low Speed rate of up to 1.5 Mbit/s (187.5 KB/s) that is mostly used for Human Interface Devices (HID) such as keyboards, mice, and joysticks; 2) A Full Speed rate of up to 12 Mbit/s (1.5 MB/s). Full Speed was the fastest rate before the USB 2.0 specification and many devices fall back to Full Speed. Full Speed devices divide the USB bandwidth between them in a first-come first-served basis and it is not uncommon to run out of bandwidth with several isochronous devices. All USB Hubs support Full Speed; 3) A Hi-Speed rate of up to 480 Mbit/s (60 MB/s).

From an electrical standpoint, the higher data transfer rates of the non-USB protocols discussed above are highly desirable for certain applications. However, these non-USB protocols are not used as broadly as USB protocols. Many portable devices are equipped with USB connectors other than these non-USB connectors. One important reason is that these non-USB connectors contain a greater number of signal pins than an existing USB connector and are physically larger as well. For example, while the PCI Express is useful for its higher possible data rates, a 26-pin connectors and wider card-like form factor limit the use of Express Cards. For another example, SATA uses two connectors, one 7-pin connector for signals and another 15-pin connector for power. Due to its clumsiness, SATA is more useful for internal storage expansion than for external peripherals.

USB 3.0 specification was released and standardized by the USB-IF, a connector in accordance with USB 3.0 standard can provide higher data transmitting efficiency and can be used for external hard disk. A USB 3.0 connector is compatible to standard Universal Serial Bus (USB) 2.0 connector and can support data rate of up to 5 Gbit/s.

As the USB 3.0 connector has two groups of contacts, the USB 3.0 connector has complex structure and the cost of manufacturing thereof will be higher, and it's difficult for assembling. Furthermore, Cross-talk may be occurred between the contacts used for transmitting high speed data.

Further, with the trend of miniaturization, micro USB connectors have been popular, and USB 3.0 connectors comprise a kind of micro USB.

CN patent No. 201323356Y issued to Xiao on Oct. 7, 2009 discloses a cable connector assembly in accordance with USB 3.0 standard, the cable connector assembly comprises an insulative housing, a plurality of contacts received in the insulative housing, a metallic shell enclosing the insulative housing and a pair of latches retained in the insulative housing and exposed out of the metallic shell. Tail portions of the contacts are extending beyond a rear end of the insulative housing to be electrically connected with a cable.

As the trend of miniaturization, some manufacturers design a spacer assembled to the insulative housing with tail portions of contacts disposed in corresponding grooves of the spacer, thus the contacts be solder to cables easily, and cross-talk may be reduced. However combinations between the spacer and the insulative housing and the metallic shell are unstable, while an insulator over-molded on the aforementioned components, the combinations may be broken.

Hence, it is desirable to have an improved structure to overcome the above-mentioned disadvantages of the prior art.

BRIEF SUMMARY OF THE INVENTION

Accordingly, the object of the present invention is to provide a cable connector assembly with improved contacts.

In order to achieve the above-mentioned object, a cable connector assembly in accordance with the present invention comprises an insulative housing, a plurality of contacts received in the insulative housing, a metallic shell enclosing the insulative housing and a spacer assembled to the insulative housing and supporting the contacts. The insulative housing includes a base portion, a first tongue and a second tongue extending forward from the base portion. The contacts comprise a plurality of first contacts held in the first tongue and a plurality of second contacts held in the second tongue. At least one of the contacts comprises a main body extending along a mating direction, a pair of vertical soldering portions and a pair of connecting portions connected with the main body and the corresponding soldering portions, the pair of connecting portions are connected with a top edge and a bottom edge of the main body, and the connecting portions are located on different levels, the pair of soldering portions are stagger with each other, and, and in mirror relationship with each other along a diagonal direction.

Other objects, advantages and novel features of the invention will become more apparent from the following detailed description of the present embodiment when taken in conjunction with the accompanying drawings.

DETAILED DESCRIPTION OF THE INVENTION

Figure 1:
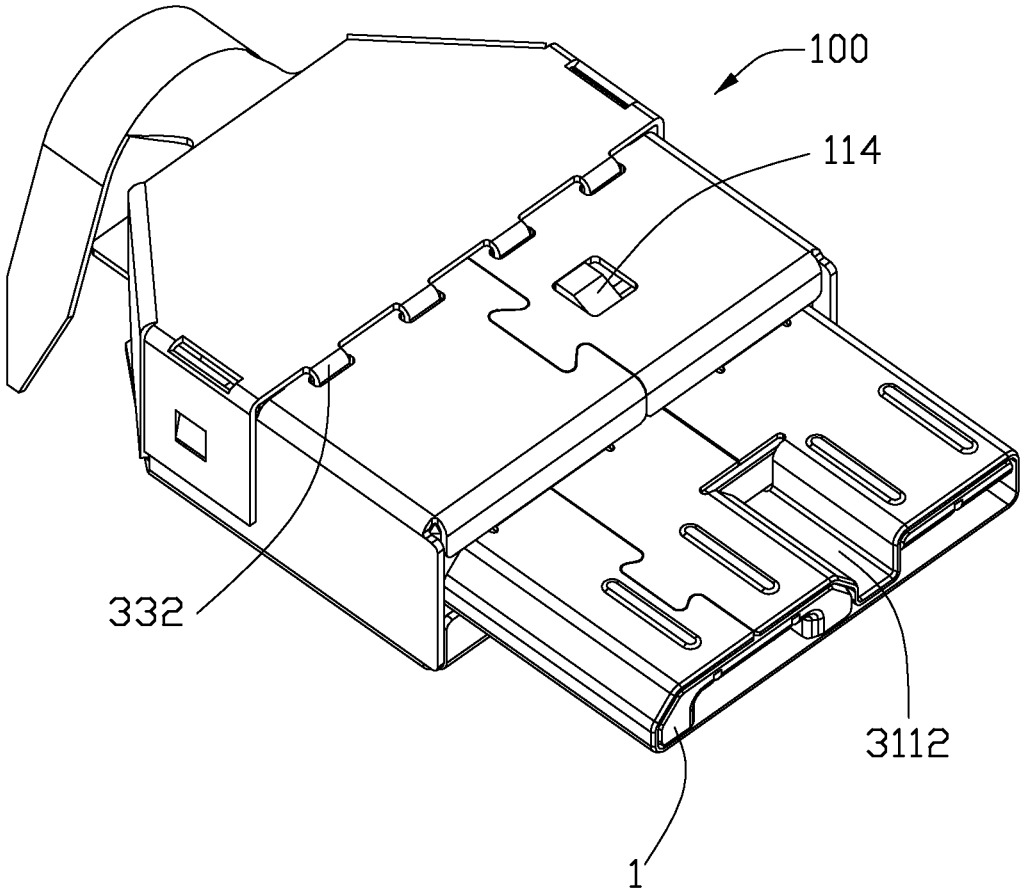
FIG. 1 is an assembled perspective view of a cable connector assembly in accordance with the present invention.

Reference will now be made to the drawing figures to describe the present invention in detail.

Referring to FIGS. 1-5, a cable connector assembly 100 made in accordance with the present invention comprises an insualtive housing 1, a plurality of contacts 2 held in the insulative housing 1, a metallic shell 3 enclosing the insualtive housing 1, a pair of latches 4 retained in the insulative housing 1 and exposed out of the metallic shell 3, a spacer 5 fastened to the insulative housing 1 to support contacts 2 and a cable 6 electrically connected with the contacts 2.

Referring to FIGS. 2-9, the insulative housing 1 includes a base portion 11 and a tongue portion 12 integrally extending forwardly beyond the base portion 11. The tongue portion 12 is split into a first tongue 121 and a second tongue 122 side by side arranged with each other and disposed in a common horizontal plane. The first tongue 121 is wider than the second tongue 122. The base portion 11 comprises a bottom surface 111, a top surface 112 and a pair of lateral walls 113, the bottom surface 111 defines a pair of first openings 1111 with different sizes, and each first opening 1111 has a first tab 1112 therein. The top surface 112 defines a pair of second openings 1121 with different sizes, and each second opening 1121 has a second tab 1122 therein. Each lateral wall 113 defines a first slot 1131 along a mating direction and a second slot 1132 perpendicular to the first slot 1131. The second slot 1132 is communicated with the first slot 1131 and deeper than the first slot 1131. The base portion 11 defines a pair of third tabs 114 on the bottom surface 111 and the top surface 112 respectively, and the third tabs 114 are neighboring to a back end of the base portion 11. The base portion 11 defines a locking hole 115 recessed rearwards from a front end thereof, and the locking hole 115 is neighboring to the tongue portion 12. The base portion 11 defines a pair of outlets 116 recessed forwardly from the back end thereof.

The bottom surface (not labeled) of the first tongue 121 and the bottom surface (not labeled) of the second tongue 122 are located on a same horizontal level defined by the common horizontal plane, to make sure the cable connector assembly 100 with a low profile, and the size of the first tongue 121 is accordance with USB 2.0 standard. The first tongue 121 has a first rear segment 1210 mechanically connected with the base portion 11 and a first front segment 1212 away from the base portion 11. Relative to the first tongue 121, the second tongue 122 defines a second rear segment 1220 and a second front segment 1222. The first rear segment 1210 and the second rear segment 1220 are of a unitary configuration to make the tongue portion 12 stable, and the first front segment 1212 and the second front segment 1222 are spaced apart from each other to form two independent mating ports.

The first tongue 121 defines a plurality of first passages 1213 parallel to each other with corresponding bottom portions located at a same horizontal plane, the first passages 1213 are extending along the mating direction, and extending through the base portion 11. A pair of channels 1214 are defined on lateral sides of the first passages 1213 to receive the latches 4, and the channels 1214 are extending through the base portion 11.

Similar to the first tongue 121, the second tongue 122 defines a number of second passages 1223 parallel to the first passages 1213, and the second passages 1223 are extending through the base portion 11.

The contacts 2 include a group of first contacts 21 and a group of second contacts 22, and the first contacts 21 are received in the corresponding first passages 1213 with the second contacts 22 received in the corresponding second passages 1223. The first contacts 21 are compatible to version 2.0 Micro Universal Serial Bus.

Each contact 2 comprises a contacting portion 23 extending along the mating direction, a retaining portion 24 extending rearwards from the contacting portion 23, and a tail portion 25 extending or bent from the retaining portion 24. The contacting portion 23 is located in a vertical plane and the tail portion 25 is located in the same vertical plane or another vertical plane. The tail portions 25 of the two contacts on left side of each group are located in a same vertical surface, and the tail portion 25 of the left one is extending backwards from the retaining portion 24 horizontally, the tail portion 25 of the second left one is extending from a bottom edge of the corresponding retaining portion 24 towards left side horizontally and then bent downwards. And the tail portions 25 of the two contacts on right side of each group are located on another vertical surface, and the tail portion 25 of the right one is extending backwards from the corresponding retaining portion 24 horizontally, the tail portion 25 of the second right one is extending from an upper edge of the corresponding retaining portion 24 towards right side horizontally and then bent upwards.

The second contacts 22 include five conductive contacts, and a grounding contact 221 is located in the middle of the second contacts, the grounding contact 221 is sandwiched between a pair of second contacts 22 receiving high speed data and a pair of second contacts 22 transmitting high speed data, to prevent cross-talk.

The grounding contact 221 has a special rear section different from other second contacts 22, and comprises a main body 2210 extending along the mating direction and located in a vertical plane perpendicular to the horizontal plane, a pair of soldering portions 2212 respectively located in two different vertical planes perpendicular to the horizontal plane and a pair of connecting portions 2214 linking the main body 2210 with the pair of soldering portions 2212. The main body 2210 comprises a contacting portion 23, a retaining portion 24 and a tail portion 25 extending backwards from the retaining portion 24. The pair of soldering portions 2212 are respectively located on left side and right side of the main body 2210, in other words, the pair of soldering portions 2212 are staggered with each other. The connecting portions 2214 are connected with a top edge and a bottom edge of the main body 2210, and located on different horizontal level. One of the pair of soldering portions 2212 on left side is coplanar to the tail portions 25 of the two contacts 2 on left side of each group, and the soldering portion 2212 is located above the two tail portions 25. The other soldering portion 2212 on right side is coplanar to the tail portions 25 of the two contacts 2 on right side of each group, and the soldering portion 2212 is located below the two tail portions 25, that is to say, the pair of soldering portions 2212 are staggered with each other along a vertical direction. The pair of soldering portions 2212 are not in alignment with each other along a transversal direction.

The first contacts 21 also have five conductive contacts, and the one in the middle thereof is a signal contact 211, and the signal contact 211 has the same configuration as the grounding contact 221. The remaining four of the first contacts 21 comprise a power contact, a signal contact, an identification contact and a grounding contact in turn. The middle signal contact 211 comprises a main body 2110 extending along the mating direction and located in a vertical plane, a pair of soldering portions 2112 respectively located in two different vertical planes and a pair of connecting portions 2114 respectively linking the main body 2110 with the two soldering portions 2112. The main body 2110 comprises a contacting portion 23, a retaining portion 24 and a tail portion 25 extending backwards from the retaining portion 24. The remaining four of the five first contacts 21 define four tail portions 25 functioning as soldering portions, and on the other hand two soldering portions 2212 formed by two sides of the tail portion 25 of the signal contact 211 for soldering with the cable 6. Thus the six soldering portions 25, 2212 of five first contacts 21 are equally divided into two vertical rows for soldering easily.

The metallic shell 3 includes a shielding member 31, a bottom shell 32 and a top shell 33. The shielding member 31 comprises a sleeve portion 311 in the front thereof and a plurality of locking portions 312 extending rearwards from the sleeve portion 311, and each locking portion 312 has a through hole 3120. A pair of the locking portions 312 on an upper side are arranged side by side closely, and the other one locking portions 312 is spaced apart from the pair of the locking portions 312 to form a vacant area. A pair of legs 313 are extending rearwards from the sleeve portion 311, and disposed in the vacant area in a back to back manner. The sleeve portion 311 defines a depression 3112 relative to a gap between the first front segment 1212 and the second front segment 1222, and the depression 3112 is divided the sleeve portion 311 into two mating cavities 3113 for receiving the first tongue 121 and the second tongue 122. The sleeve portion 311 defines a pair of notches 3114 receiving the latches 4.

The bottom shell 32 comprises an engaging portion 321 with a tube shape, the engaging portion 321 has a joining line 3210 on an upper wall thereof, a plurality of apertures 3211 are defined behind the engaging portion 321, and a positioning hole 3212 is disposed in front of the apertures 3211. The bottom shell 32 also has another positioning hole 3212 on a lower wall thereof. Furthermore, the bottom shell 32 defines a pair of stopping flanges 323 on front ends thereof, and the stopping flanges 323 are opposite to each other.

The top shell 33 is cooperated with a rear section of the bottom shell 32, and comprises a pair of slits 331 on both sides and a plurality of teeth 332 on a front edge. The teeth 332 are inserted into the corresponding apertures 3211 of the bottom shell 32 to make the top shell 33 be fastened to the bottom shell 32.

Each latch 4 comprises a retaining standoff 41 held in the base portion 11 of the insulative housing 1 and an engaging arm 42 extending forwards from the retaining standoff 41, the engaging arm 42 is received in the relative channel 1214 of the insulative housing 1.

The spacer 5 is made of insulative material, and comprises a primary portion 51, a pair of rectangular extension portions 52 extending backwards from a rear end of the primary portion 51, a pair of rectangular protrusions 53 extending forwards from a front end of the primary portion 51 and a pair of elongate arms 54 extending forwards from lateral sides of the primary portion 51. The protrusions 53 have a top plane coplanar to an upper surface of the primary portion 51 and a top wall of the extension portion 52, and a bottom plane of the protrusions 53 is coplanar to a lower surface of the primary portion 51 and a bottom wall of the extension portion 52. The two extension portions 52 are spaced apart from each other to form a gap 56, and the distance between the extensions 52 is larger than the protrusions 53. A plurality of grooves 521 are defined on a left side wall and a right side wall of each extension portion 52, for receiving the tail portions 25 of the contacts 2, and each extension portion 52 has three grooves 521 on the left side wall and the right side wall respectively.

Each protrusion 53 comprises a plurality of gateways 531 recessed from a front end thereof along a front-to-back direction and a plurality of cutouts 532 communicated with the corresponding gateways 531. The gateways 531 are defined in a vertical direction, and the cutouts 532 are defined along a horizontal direction, the gateways 531 on both sides of each protrusion 53 are extending through the protrusion 53 and the primary portion 51 from the front end of the protrusions 53, and communicated with the corresponding grooves 521. The gateways 531 on inner side of each protrusion 53 are extending backwards but not through the primary portion 51, thus the gateways 531 are isolated in the primary portion 51. Each elongate arm 54 defines a tuber 541 on a front end thereof for assorting with the corresponding lateral wall 113 of the insulative housing 1. A block 55 is disposed on a front end of the spacer 5, and located between the pair of protrusions 53, the block 55 has a small size.

The cable 6 includes two groups, and a first group cable is electrically connected with the first contacts 21, the first group cable comprises five independent wires 61, and each wire 61 has a first inner conductor 611 and an insulative outer jacket 612. A second cable includes two Shielded Twisted Pair (STP) cables 62 for transmitting high speed signal, and each STP cable 62 comprises a pair of second inner conductors 621, an insulator 622 enclosing each second inner conductor 621, a grounding wire 623 and a shielding layer 624 enclosing the second inner conductors 621 and the shielding layer 624. An insulative outer jacket is enclosing each shielding layer 624 of the STP cable or the two STP cable 62.

Figure 2:
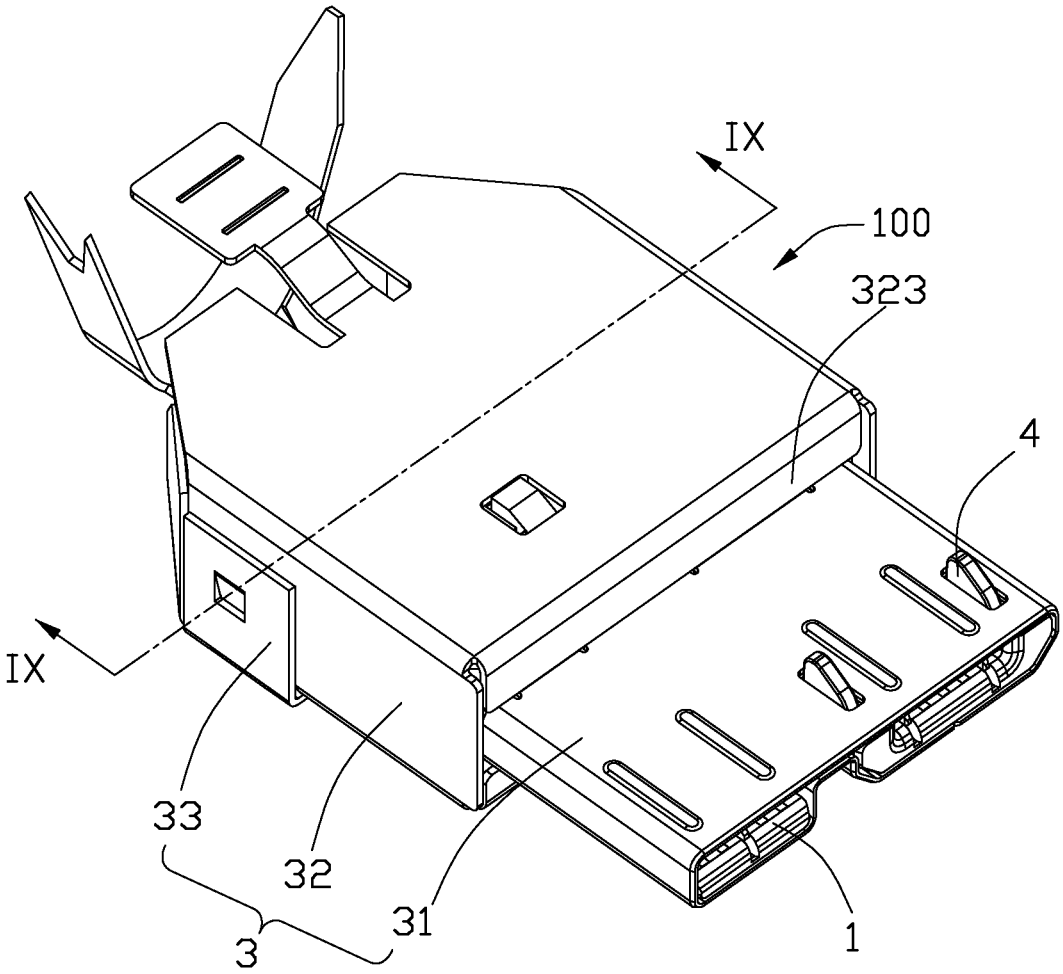
FIG. 2 is a view similar to FIG. 1, but viewed from a different angle.
Figure 3:
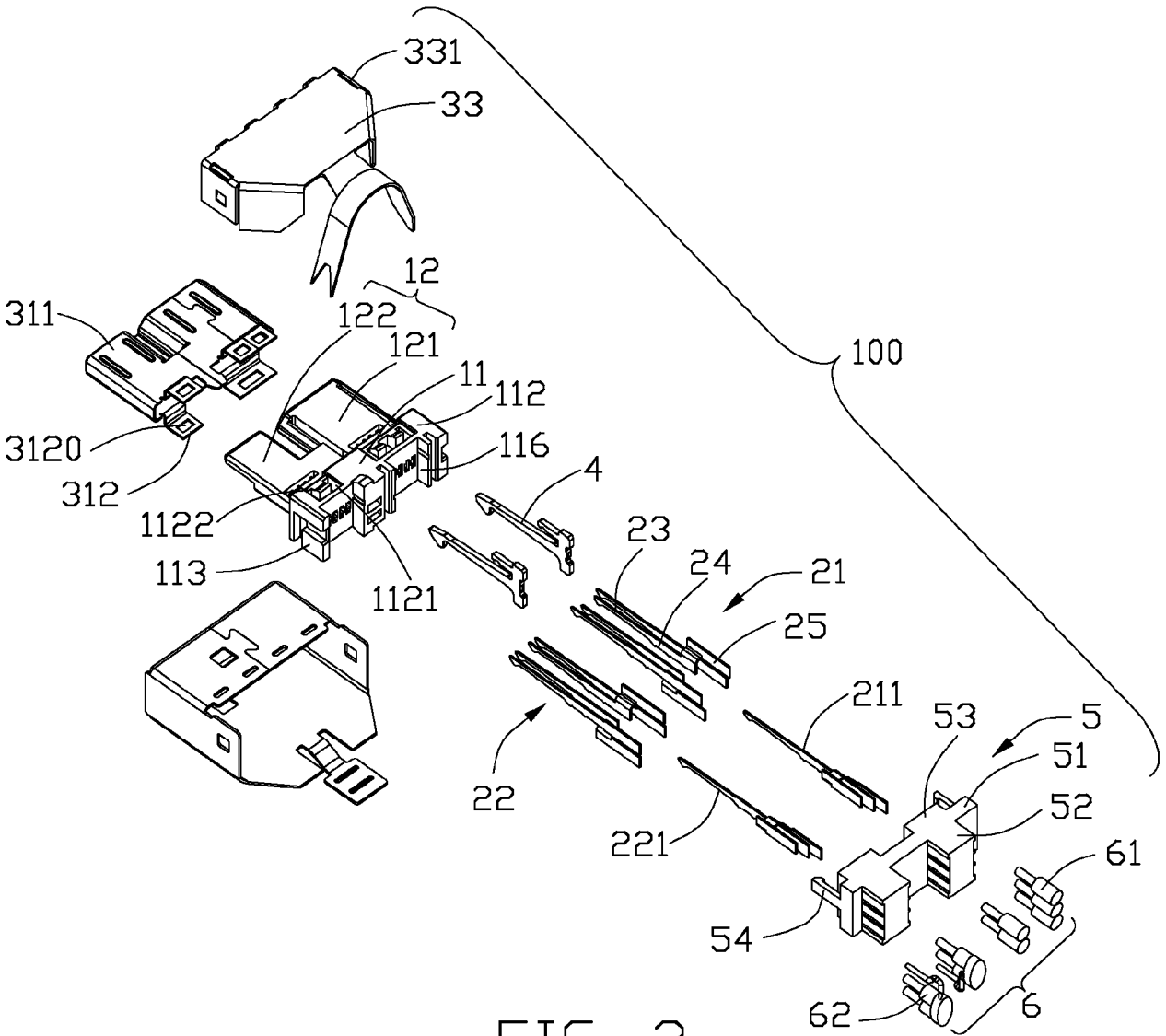
FIG. 3 is an exploded perspective view of the cable connector assembly shown in FIG. 1.
Figure 4:
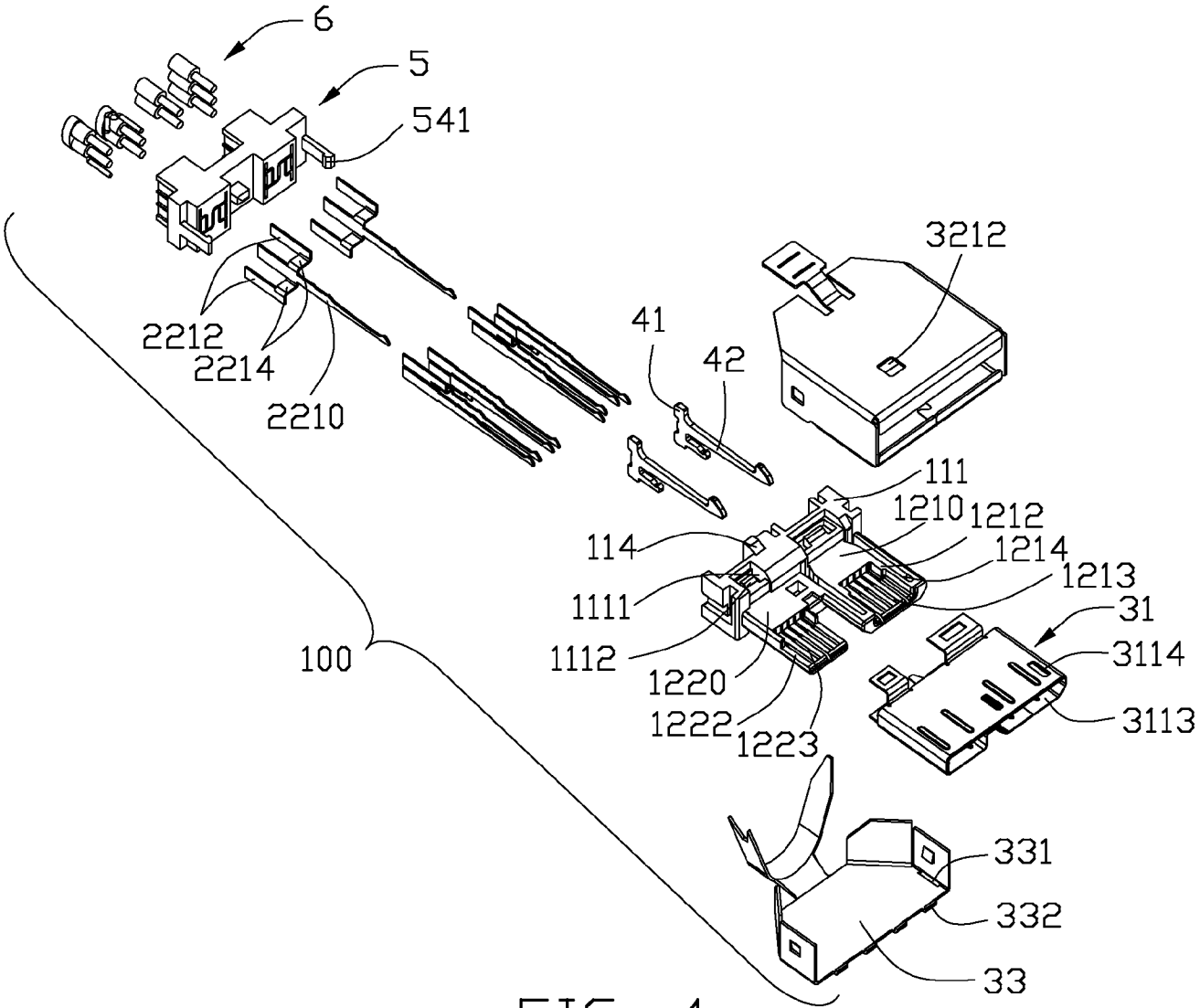
FIG. 4 is a view similar to FIG. 3, but viewed from another aspect.
Figure 5:
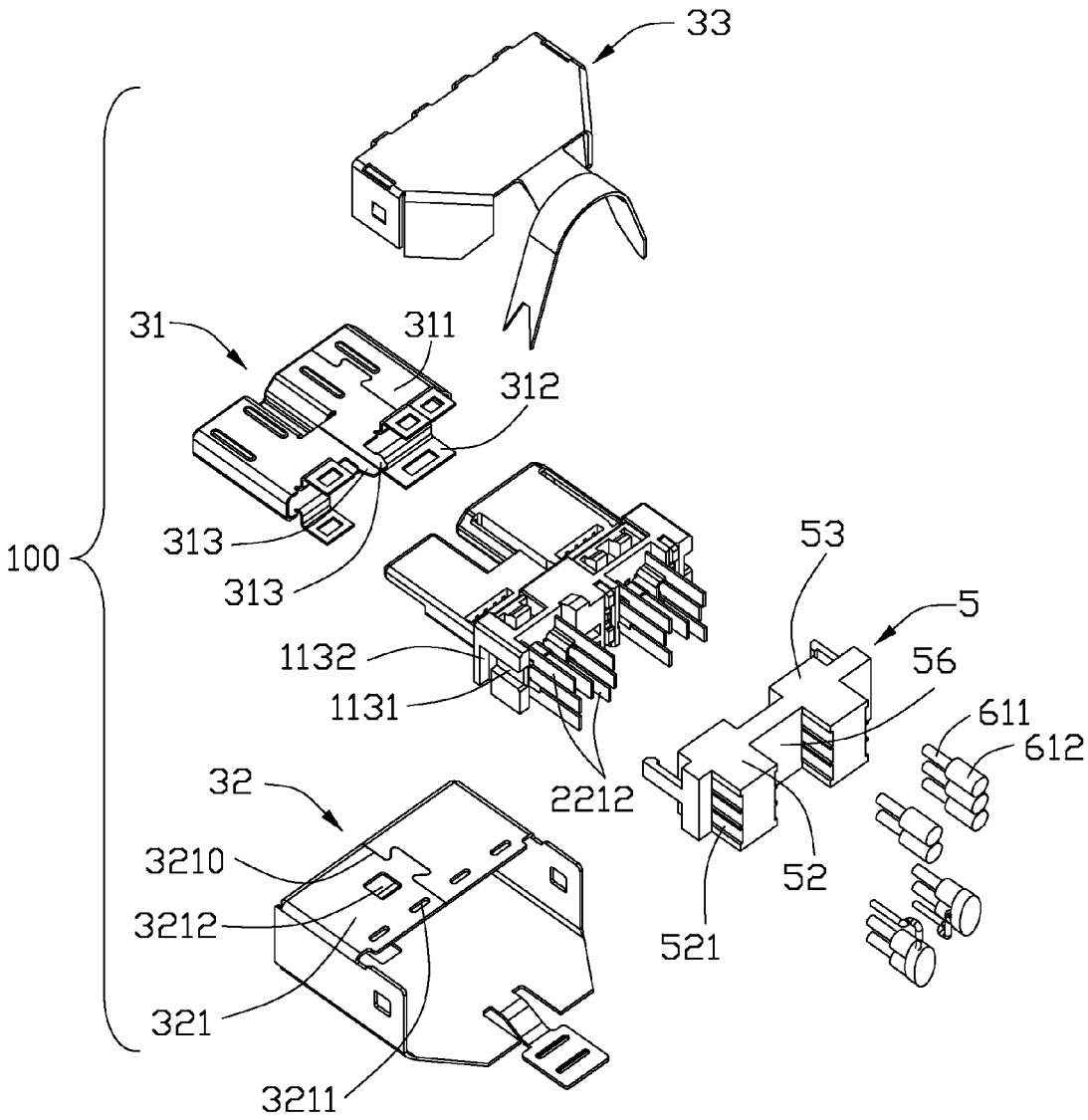
FIG. 5 is a partially assembled view of FIG. 4.
Figure 6:
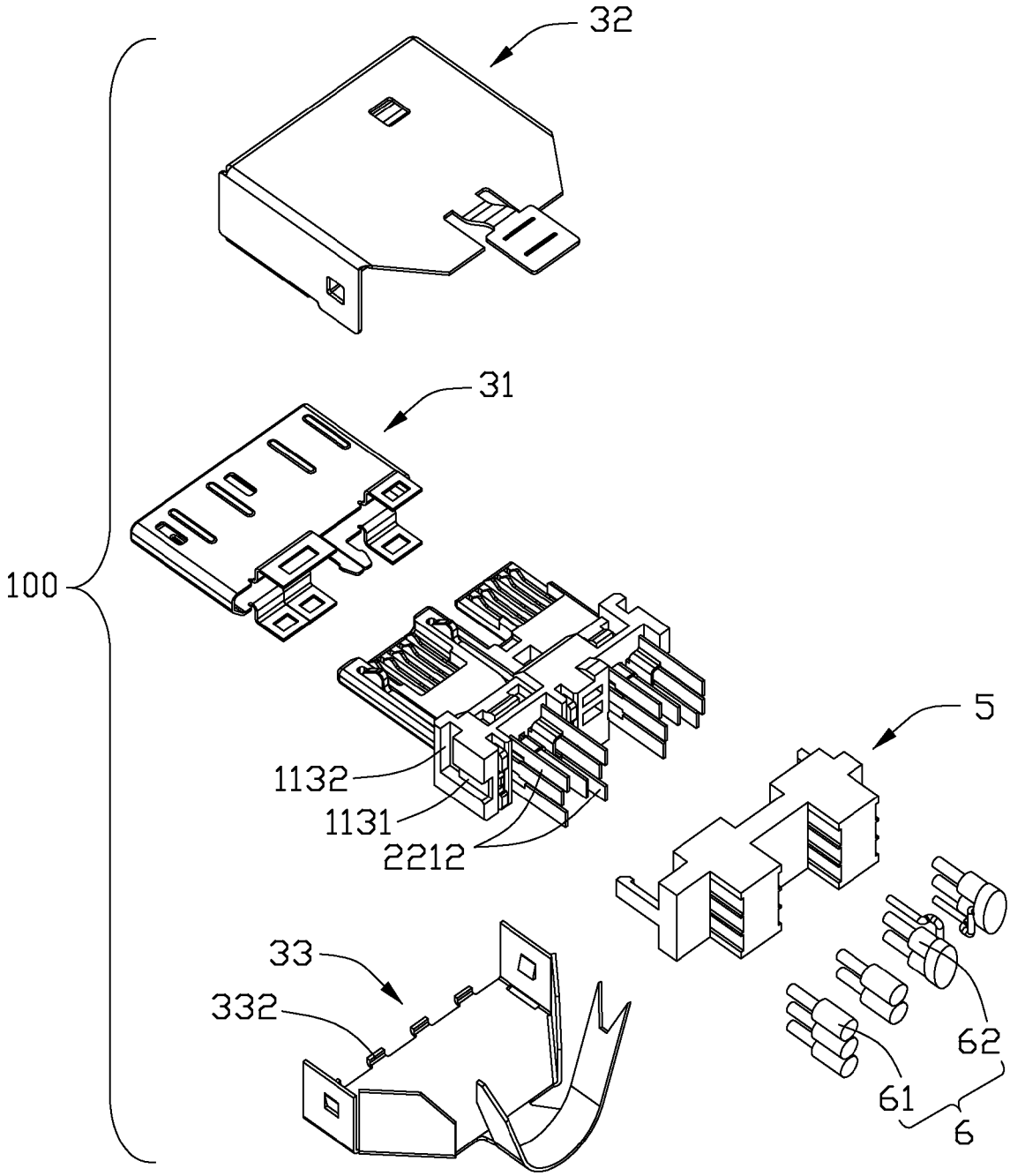
FIG. 6 is a view similar to FIG. 5, but viewed from a different angle.
Figure 7:
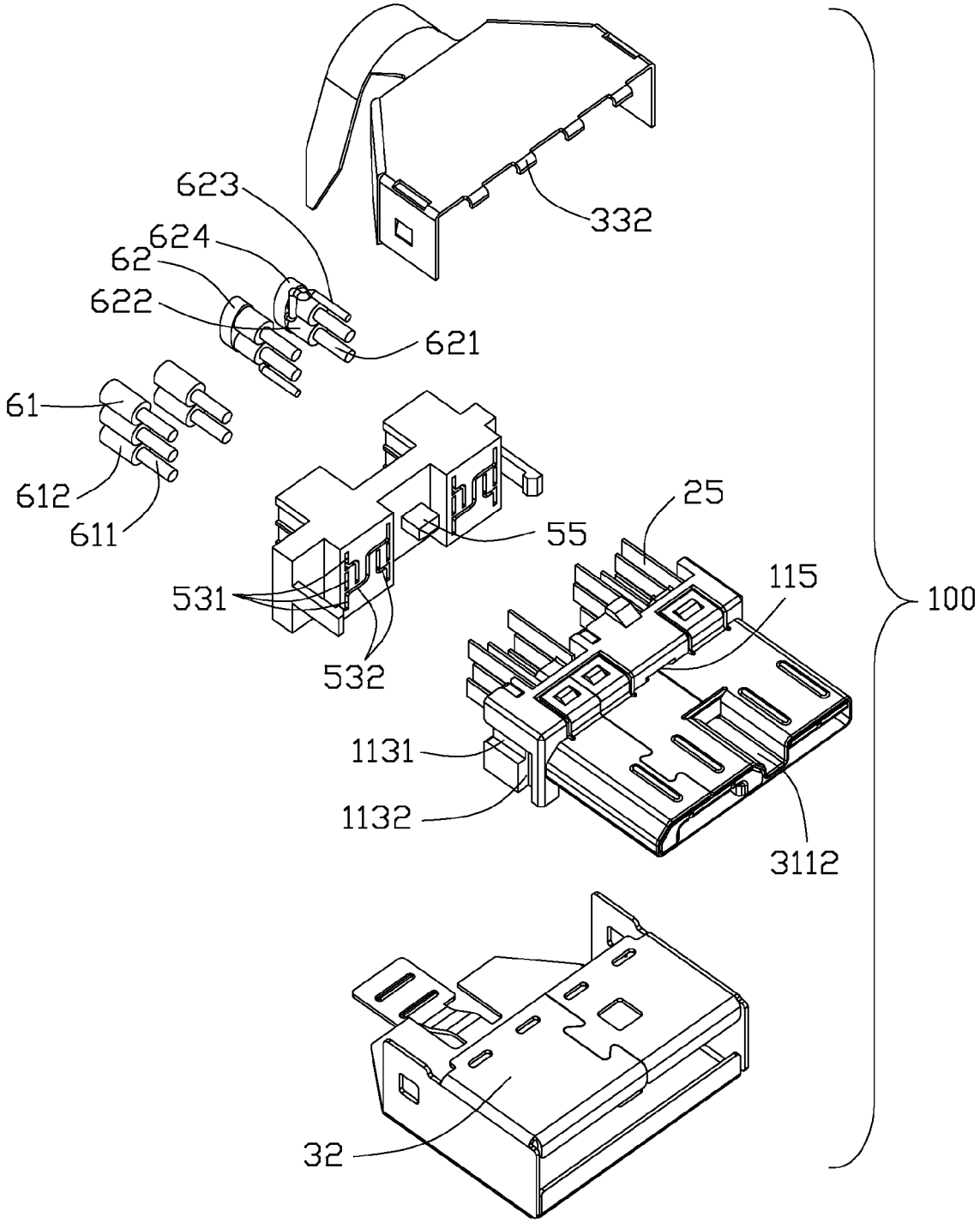
FIG. 7 is a further assembled view of FIG. 5.
Figure 8:
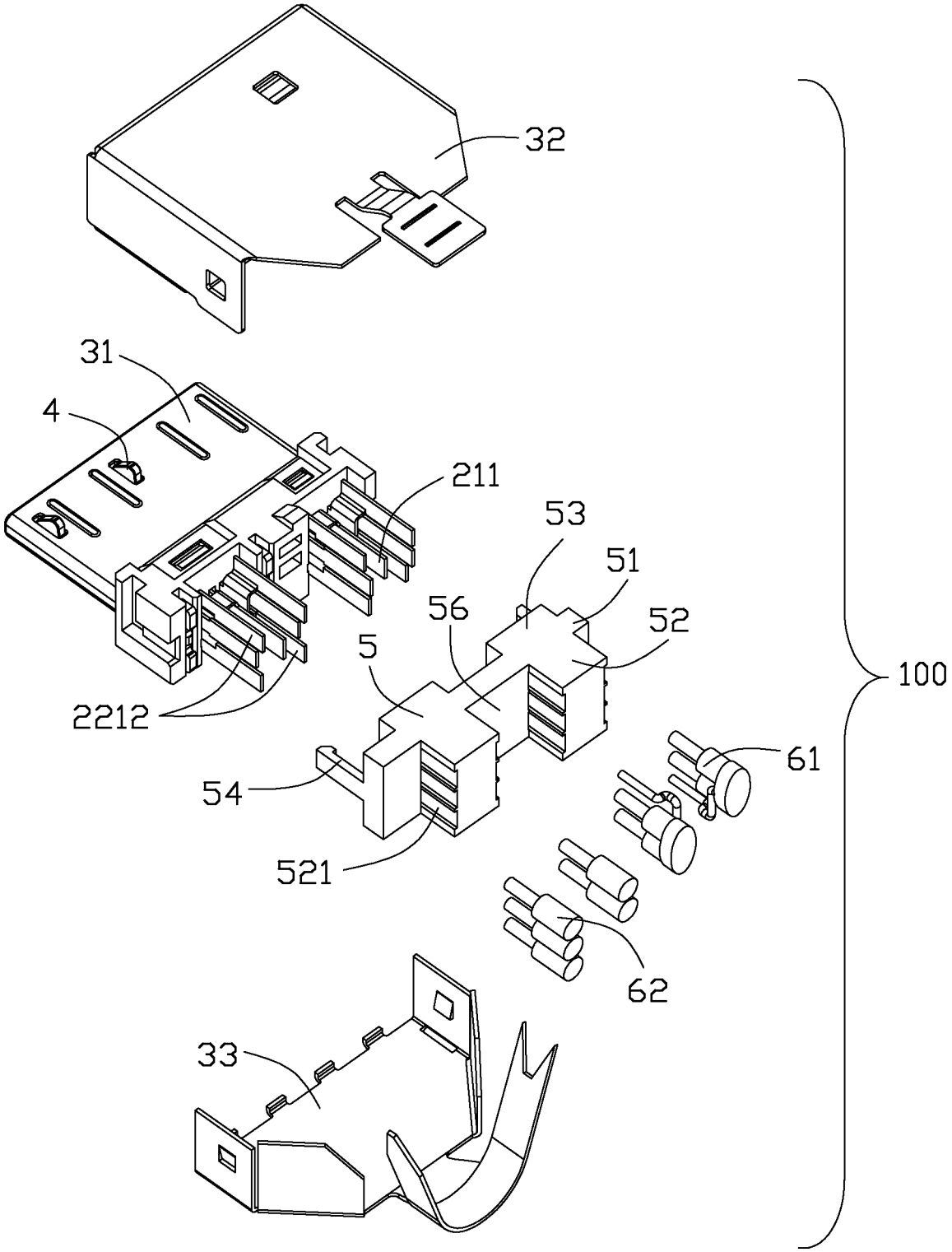
FIG. 8 is a view similar to FIG. 7, but viewed from a different angle.
Figure 9:
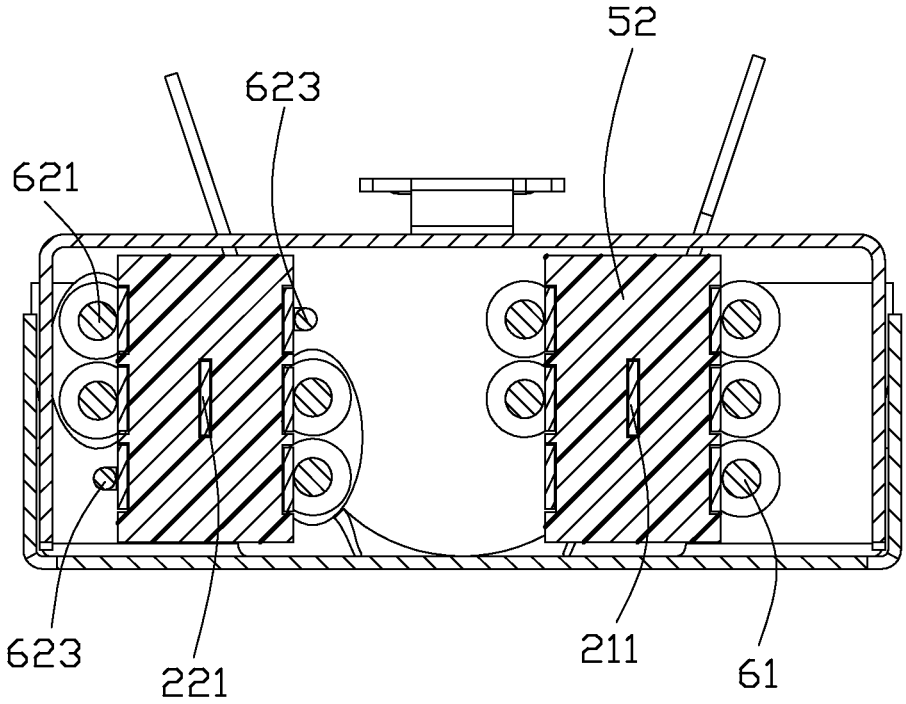
FIG. 9 is a cross-section view taken along line 9-9 of FIG. 2.
Figure 10:
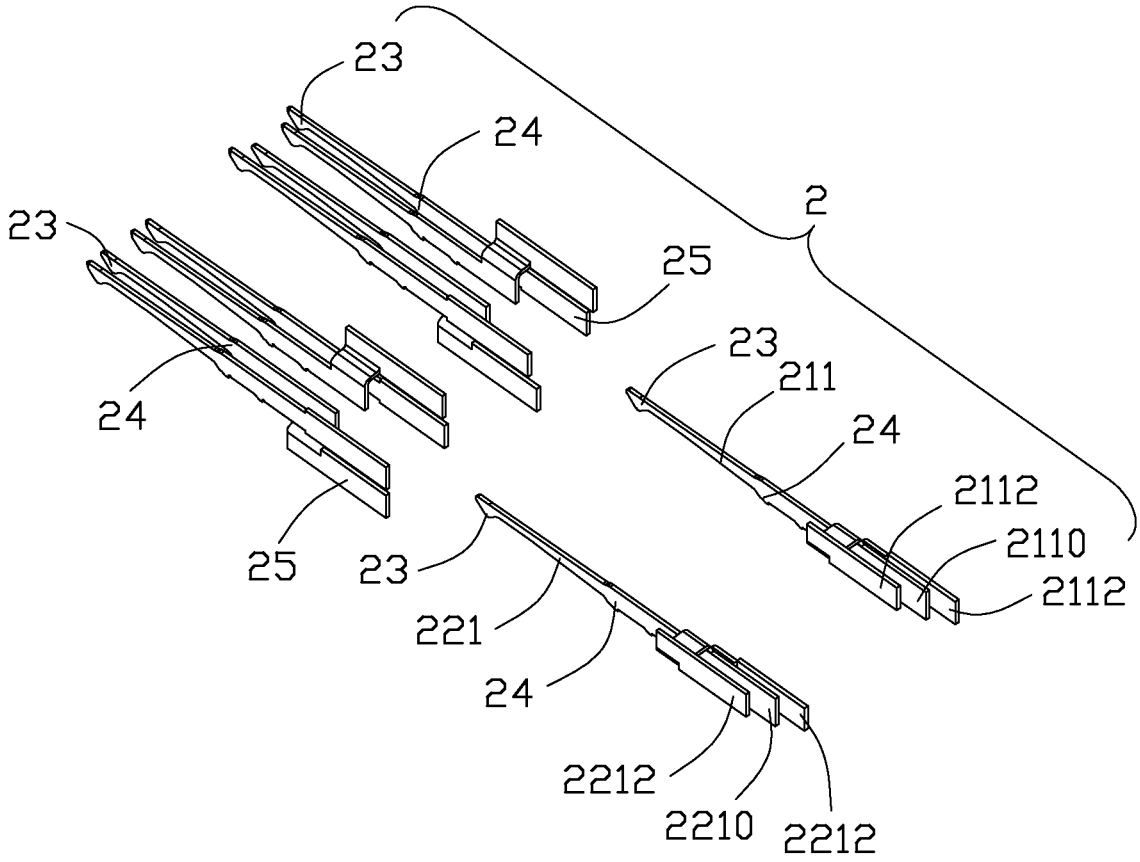
FIG. 10 is an enlarged perspective view of a plurality of contacts shown in FIG. 3.
Figure 11:
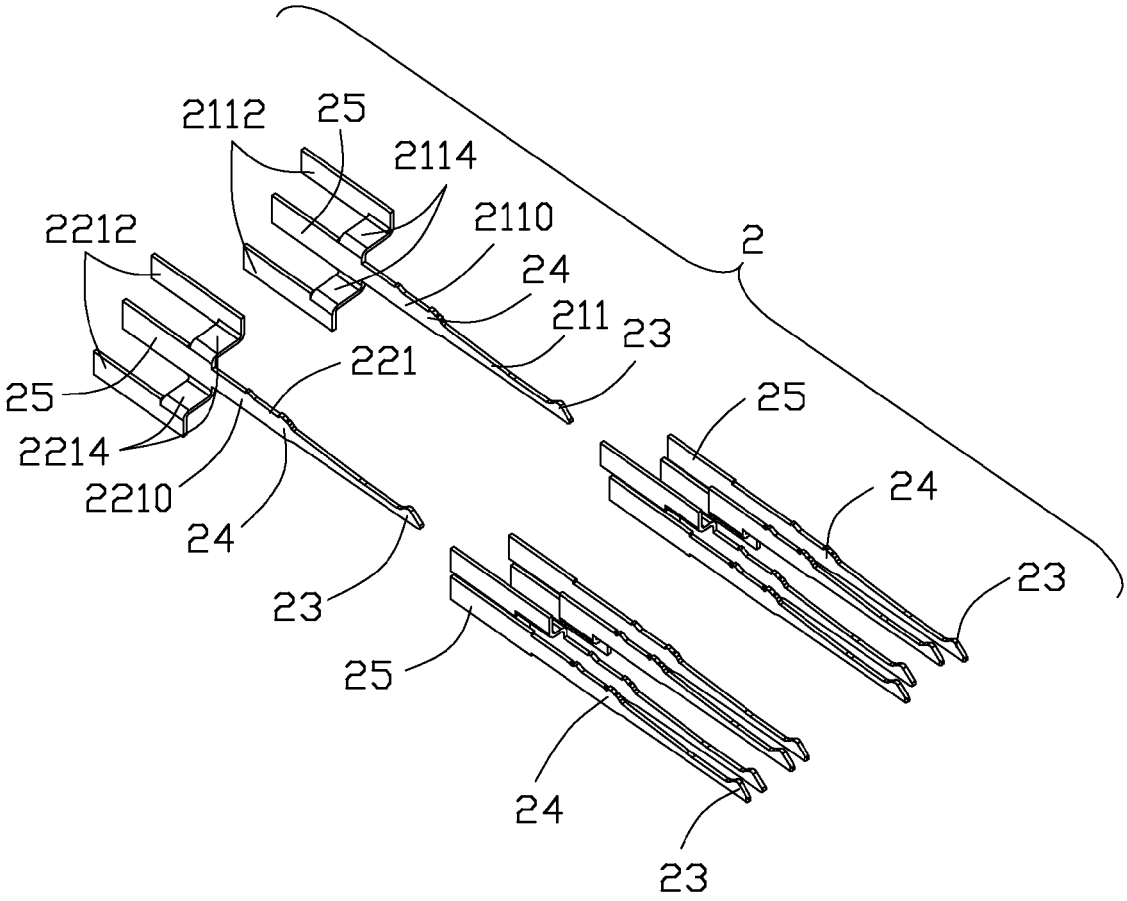
FIG. 11 is an enlarged perspective view of a plurality of contacts shown in FIG. 4.

Referring to FIGS. 1-2 and conjunction with FIGS. 6-8, in assembly, the contacts 2 are inserted into the insulative housing 1 along a back-to-front direction, the first contacts 21 and the second contacts 22 are accommodated in the first passages 1213 of the first tongue 121 and the second passages 122 of the second tongue 122 respectively, the latches 4 are inserted into the channels 1214 of the first tongue 121. The tail portions 25 of the contacts 2 are exposed beyond the insulative housing 1. Then the spacer 5 is assembled to a back end of the insulative housing 1 along the back-to-front direction. The protrusions 53 of the spacer 5 are accommodated in the corresponding outlets 116 of the insulative housing 1, to prevent the spacer 5 moving relative to the insulative housing along a transverse direction. The block 55 of the spacer 5 is interferentially cooperated with an indentation (not labeled) on the back end of the insulative housing 1.

The tail portions 25 of the contacts 2 are inserted into the cutouts 532 of the spacer 5, and rear sections of the retaining portions 24 are inserted into the gateways 531, the tail portions 25 are extending through the cutouts 532 and exposed in the grooves 521 of the extension portion 52. A rear section of the main body 2210 of the contact 2 in the middle of each group is isolated in the extension portion 52 of the spacer 5. The wires 61 of the cable 6 are soldered to corresponding tail portions 25 of the first contacts 21, and one of the six soldering portions of the first contacts 21 is free without soldering with wires. The two pairs of second inner conductors 621 are connected with two pairs of differential contacts 22, and the two grounding wires 623 are soldered to the corresponding soldering portions 2212 of the grounding contact 221. The tail portions 25 of the contacts 2 can be soldered with cable in the gap 56.

Then the insulative housing 1 is assembled into the shielding member 31, the tongue portion 12 of the insualtive housing 1 is received in the sleeve portion 311 of the shielding member 31, and the first tongue 121 and the second tongue 122 are received in the mating cavities 3113 respectively. The two mating cavities 3113 can prevent the first and second front segment 1212, 1222 swaying. The engaging arms 42 of the latches 4 are received in the notches 3114 and exposed out of the shielding member 31. The first tabs 1112 and the second tabs 1122 of the insulative housing 1 are inserted into the corresponding through holes 3120 of the shielding member 31. The legs 313 extending from the back end of the shielding member 31 are inserted into the locking hole 115 to enhance the combination between the shielding member 31 and the insulative housing 1. Then the bottom shell 32 is enclosing the aforementioned elements, the third tabs 114 on the insulative housing 1 are received in the corresponding positioning holes 3212 of the bottom shell 32, and the stopping flanges 323 of the bottom shell 32 are adjacent to the front end of the base portion 11 of the insulative housing 1. Then the top shell 33 is assembled to the bottom shell 32 along an up-to-down direction, The teeth 332 of the top shell 33 are latched in the corresponding apertures 3211 of the bottom shell 32, to make the conjunction between the shielding member 31, the bottom shell 32. the top shell 33 and the insulative housing 1 stable, thus, the cable connector assembly 100 is assembled.

The cable connector assembly 100 is compatible to standard USB 2.0 connector. The size of the first tongue 121 and the arrangement of the first contacts 21 are in accordance with USB 2.0 plug connector standard.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly, comprising: an insulative housing including a base portion, a first tongue and a second tongue extending forwards from the base portion, a bottom surface of the first tongue and another bottom surface of the second tongue disposed in a common horizontal plane; a plurality of contacts received in the insulative housing, and comprising a group of first contacts held in the first tongue and a group of second contacts held in the second tongue; a metallic shell enclosing the insulative housing; a spacer assembled to the insulative housing and supporting the contacts; and a cable electrically connected with the contacts; wherein at least one of the contacts comprises a main body extending along a mating direction, a pair of vertical soldering portions perpendicular to the common horizontal plane and a pair of connecting portions connected with the main body and the corresponding soldering portions, the pair of connecting portions are connected with a top edge and a bottom edge of the main body, and the connecting portions are located on different levels, the pair of soldering portions are located on different vertical planes.

2. The cable connector assembly as claimed in claim 1, wherein the cable includes two groups, one group of the cable is used for transmitting high speed signal, and defines two grounding wires connected with the corresponding soldering portion.

3. The cable connector assembly as claimed in claim 1, wherein each contact comprises a contacting portion extending along a mating direction, a retaining portion extending rearwards from the contacting portion, and a tail portion extending from the retaining portion, the tail portion is located in a vertical plane perpendicular to the common horizontal plane.

4. The cable connector assembly as claimed in claim 1, wherein a rear section of the main body of the contact in the middle of each group is isolated in the spacer.

5. The cable connector assembly as claimed in claim 1, wherein the spacer comprises a primary portion and a pair of rectangular extension portions extending backwards from a rear end of the primary portion, and the two extension portions are spaced apart from each other to form a gap.

6. The cable connector assembly as claimed in claim 5, wherein a plurality of grooves are defined on a left side wall and a right side wall of each extension portion, for receiving the tail portions of the contacts.

7. The cable connector assembly as claimed in claim 6, wherein the spacer also comprises a pair of rectangular protrusions extending forwards from a front end of the primary portion, each protrusion comprises a plurality of gateways recessed backwards and a plurality of cutouts communicated with the corresponding gateways.

8. The cable connector assembly as claimed in claim 7, wherein the gateways on both sides of each protrusion are extending through the protrusion and the primary portion from a front end of the protrusion, and communicated with the corresponding grooves.

9. The cable connector assembly as claimed in claim 1, wherein the spacer defines a pair of elongate arms extending forwards from lateral sides of the primary portion, each lateral wall of the insulative housing defines a first slot along a mating direction and a second slot perpendicular to the first slot for locking with the elongate arm.

10. The cable connector assembly as claimed in claim 7, wherein the insulative housing defines a pair of outlets recessed forwardly from a back end thereof, the protrusions are accommodated in the corresponding outlets.

11. The cable connector assembly as claimed in claim 1, wherein the metallic shell defines a pair of legs extending backwards, the insulative housing defines a locking hole recessed from a front end of the base portion, and the pair of legs are inserted into the locking hole and arranged in a back to back manner.

12. A cable connector assembly, comprising: an insulative housing having a first tongue and a second tongue, a bottom surface of the first tongue and another bottom surface of second tongue located in a common horizontal plane; a plurality of contacts mounted in the insulative housing and each contact has a tail portion located in a vertical plane perpendicular to the horizontal plane; a metallic shell having two mating cavities, the first tongue and the second tongue received in the corresponding mating cavities; a spacer latched with the insulative housing; and a cable electrically connected with the contacts; wherein the spacer comprises a primary portion, a pair of rectangular extension portions extending backwards from a rear end of the primary portion and a pair of rectangular protrusions extending forwards from a front end of the primary portion, and the two extension portions are spaced apart from each other to form a gap, a plurality of grooves are defined on a left side wall and a right side wall of each extension portion, for receiving the tail portions of the contacts.

13. The cable connector assembly as claimed in claim 12, wherein each contact comprises a contacting portion extending along a mating direction and a retaining portion extending rearwards from the contacting portion, the tail portions are extending backwards from the retaining portion, and the tail portions of each group are divided into two vertical rows.

14. The cable connector assembly as claimed in claim 12, wherein one of the contact in the middle of each group has a pair of soldering portions located on different vertical planes with each other.

15. A cable connector assembly comprising: an insulative housing defining a plurality of passageways with bottom portions located on a common horizontal plane and each of said passageways extending in a front-to-back direction while all said passageways commonly arranged with one another in a transverse direction perpendicular to said front-to-back direction; a plurality of contacts disposed in the corresponding passageways, respectively, each of said contacts defining a planar vertical front contacting section lying in a first vertical plane which is perpendicular to the horizontal plane, and a planar vertical rear soldering section lying in a second vertical plane perpendicular to the horizontal plane; and an insulative spacer positioned behind and attached to the housing, said spacer defining a plurality of gateways with a plurality of cutouts to allow the rear soldering sections to be inserted thereinto to reach corresponding grooves in a vertical face of the spacer which is essentially coplanar with the second vertical plane.

16. The cable connector assembly as claimed in claim 15, wherein the soldering sections of at least three contacts are located in the second vertical plane.

17. The cable connector assembly as claimed in claim 16, wherein the first vertical plane and the second vertical plane of an outermost contact in said transverse direction is essentially the same while the first vertical plane and the second vertical plane of an innermost contact in the transverse direction is essentially different from each other in an offset manner.

18. The cable connector assembly as claimed in claim 17, wherein the soldering section of a middle one of the contacts defines a Z-shaped configuration with two opposite parts respectively located in two different second vertical planes.

19. The cable connector assembly as claimed in claim 18, wherein said middle one of the contacts further includes a retention tab lying in another vertical plane between said two different second vertical planes and received in the spacer.

20. The cable connector assembly as claimed in claim 18, further including a plurality of wires connected to the corresponding soldering sections of said contacts, respectively.

* * * * *